United States Patent [19]

Hannen

[11] Patent Number: 4,575,989

[45] Date of Patent: Mar. 18, 1986

[54] METHOD AND DEVICE FOR PACKAGING PALLETIZED STACKS OF GOODS

[75] Inventor: Rainer W. Hannen, Goch, Fed. Rep. of Germany

[73] Assignee: MSK-Verpackungs-Systeme GmbH, Kalkar-Wissel, Fed. Rep. of Germany

[21] Appl. No.: 434,703

[22] Filed: Oct. 15, 1982

[30] Foreign Application Priority Data

Oct. 16, 1981 [DE] Fed. Rep. of Germany ..... 3141100
Jan. 14, 1982 [DE] Fed. Rep. of Germany ..... 3200832
Feb. 6, 1982 [DE] Fed. Rep. of Germany ..... 3204171

[51] Int. Cl.[4] ..... B65B 31/04; B65B 53/06

[52] U.S. Cl. ..... 53/434; 53/442; 53/469; 53/512; 53/557

[58] Field of Search ..... 53/434, 442, 512, 510, 53/557, 469, 570

[56] References Cited

U.S. PATENT DOCUMENTS

Re. 27,977 4/1974 Monaghan ..... 53/442
3,508,375 4/1970 Myers ..... 53/442 X
3,522,688 8/1970 Kaliwoda et al. ..... 53/442
3,589,510 6/1971 Begnaud et al. ..... 53/557 X
3,621,588 11/1971 Grocke ..... 53/557 X
3,853,218 12/1974 Grasvoll ..... 53/442 X
4,060,957 12/1977 Birkenfeld et al. ..... 53/442
4,258,533 3/1981 Aka et al. ..... 53/557

*Primary Examiner*—Horace M. Culver
*Attorney, Agent, or Firm*—Shlesinger, Arkwright, Garvey & Fado

[57] ABSTRACT

The invention concerns a device for packaging palletized stacks of goods which are brought on a chain conveyor to a wrap cover station where they are raised by an elevating platform located under the wrap cover station. A suction fan is provided under the wrap cover station which sucks in the edges of a shrink wrap drawn over the stack of goods, which edges project over the underside of the pallet, before the palletized stack of goods is lowered and transported to a shrinking station. In addition, tools for folding back the projecting edges of the shrink wrap under the pallet are located in the zone of the wrap cover station. In order that folded-back sections which are as free of folds as possible are produced on the underside of the pallet, the tools are slide plates which are located at the height of the upper side of the elevating platform when the elevating platform is raised and the plate and slide plane of which runs essentially parallel to the plane of transport.

28 Claims, 6 Drawing Figures

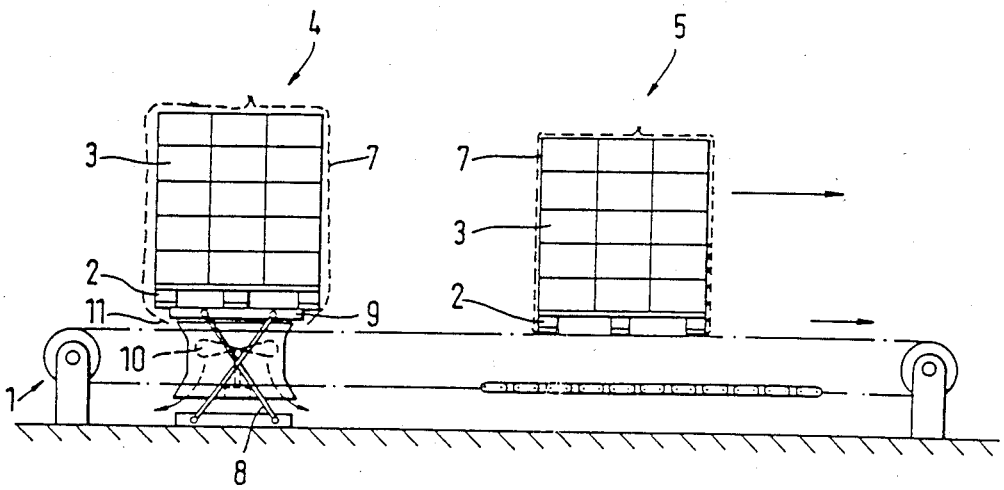
FIG. 1
FIG. 2
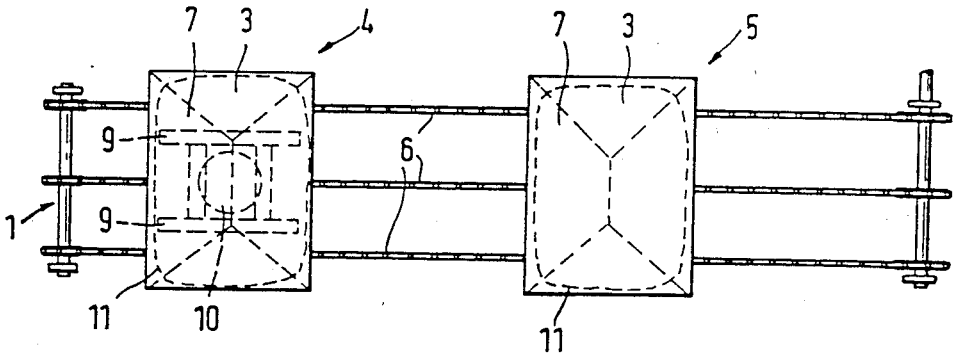

METHOD AND DEVICE FOR PACKAGING PALLETIZED STACKS OF GOODS

The invention concerns a method for packaging palletized stacks of goods in which a shrink wrap is drawn over the stack of goods and the pallet which wrap is placed against the stack of goods and the pallet and is shrunk. The invention also concerns a device for carring out the method.

Palletized stacks of goods are covered with a shrink wrap which holds the stack together and on the pallet after it has been shrunk. The shrink wrap should enclose not only the stack but also the edges of the pallet and lie at least partially against the underside of the pallet, so that the so called undershrink is produced during the shrinkage. The drawing over of the wrap and the shrinking can be automated to a large extent. For this, the palletized stacks of goods are driven on a conveyor, e.g. a roller conveyor, to the zone of a wrap cover station, provided there with a shrink wrap and then transported by the conveyor to the zone of a shrinking station, where the shrink wraps are shrunk. A shrinking station usually has a hot gas mast which can be guided around the palletized stack of goods, whereby hot gas is blown out of the hot gas mast against the surfaces of the shrink wrap.

However, the shrink wrap rises off the stack of goods, as well as off the pallet, during the transport from the wrap cover station to the shrinking station, and when the stack of goods comes to a stop, the areas of the shrink wrap involved do not fit snuggly against the stack of goods, or against the edges of the pallet, on account of the stiffness of the material and folds which may have developed. It is then necessary to intervene manually, so that the desired undershrink is produced during the shrinking.

Shrinking ovens are also known for shrinking shrink wraps; however, they are less suited for a basically automatic operation. A shrinking oven containing a palletized stack of goods, is not readily accessible or only accessible with difficulty. The shrink wrap is frequently sucked against the stack of goods, as well against the pallet, during the shrinking. Folds are formed hereby in the wrap material, because this material can take no more tensioning in a heated state. As a result, this weakens the wrap material and the outer appearance of the palletized stack of goods provided with a shrunken wrap is adversely affected.

The invention has the task of assuring that a sufficiently large undershrink occurs in the basically automatic operations of wrap covering and shrinking.

The invention solves this task in the method of the type initially described as follows: The pallet is raised when the shrink wrap is pulled on, the shrink wrap is placed against the stack of goods and under the edges of the pallet in this raised state of the pallet, the pallet is then set down and the shrink wrap is then shrunk.

The success of this method is achieved essentially as follows: The shrink wrap is squeezed in and held fast on its free edges between the underside of the pallet and the stop surface whereby it can no longer execute any free movements during the subsequent shrinking. This assures, at the same time, that the desired undershrink is produced, because a considerable part of the free edges of the shrink wrap is already under the edges of the pallet.

According to a preferred embodiment of the invention the shrink wrap should be placed against the stack of goods and under the edges of the pallet by sucking air out. It is advantageous to suck out the air from the underside of the pallet, because this method makes possible a basically automatic operation without manual intervention, since the flow forces of the air are sufficient to place the shrink foil in the matter described.

A device for carrying out the method has a conveyor for the palletized stack of goods. A wrap cover station and a shrinking station are located in the conveyor zone. The devices is characterized in that the conveyor has an air-permeable conveyor belt and that an elevating platform and a suction fan are located under the wrap cover station.

The elevating platform and the suction fan can be controlled automatically according to the intermittent advance of the conveyor. They only operate when a palletized stack of goods is present in the zone of the wrap cover station.

The conveyor can be a multi-track chain conveyor. Pallets of different sizes can also be transported by such a chain conveyor. An elevating platform can be installed in the zone of this chain conveyor with which the pallets of different sizes can be raised.

Various types of elevating platforms can be used for this purpose. In a preferred embodiment, the elevating platform is a scissor elevating platform, the carrying arms of which extend through the conveyor tracks. Then, the suction fan can be located between the carrier arms of the scissor elevating platform.

Additional holding devices can be located in the shrinking station zone to press the shrink wrap against the free sides of the stack of goods. These holding devices counteract any loosening of the shrink wrap and the lifting off of the shrink wrap.

Problems can occur in the case of pallets with a rectangular surface area, the narrow sides of which are relatively far removed from the suction fan. In this instance, the flow forces are frequently insufficient to fold the free edges of the shrink foil onto the under side of the pallet.

In order that the free edges of the shrink wrap which is drawn over the stack of goods and which projects under the underside of the pallet can be folded reliably onto the underside of the pallet, tools can be provided in the zone of the wrap cover station for folding the projecting edges of the shrink wrap onto the pallet.

These tools, which are constructed as arms in accordance with the preferred embodiment of the invention, are pivotable about vertical axles and run horizontally under the underside of the pallet. The tools act in combination with the flow forces produced by the suction fan in such a manner than even the free edges of the shrink wrap, which are relatively far removed from the suction fan, are reliably folded under the underside of the pallet. On the one hand, flow forces are still present in the zones of the narrow sides of the pallet which attempt to fold the projecting edges of the shrink wrap in the direction of the pallet center. This occasion in itself a pre-orientation of these edges. When the tools or arms are pivoted under the under side of the pallet, they push the projecting edges completely under the underside of the pallet.

The arms are driven, and they preferably have a common drive, at least on each side of the conveyor. The drive can be a lift cylinder, the piston rod of which accuates a lever transmission connected to the arms.

For its part, the lever transmission touches the vertical pivot axles of the arms and pivots them from their rest position into their operating positions and vice versa.

It is advantageous if two arms are positioned on each side of the wrap cover station. It developed that the best effects are achieved if the arms are positioned at ca. $\frac{1}{4}$ and ca. $\frac{3}{4}$, respectively, of the pallet size in the direction of transport, as well as at a distance of ca. $\frac{1}{4}$ of this size from the associated narrow side of the pallet. This makes it possible to grasp the corner areas of the projecting edges of the shrink wrap too, especially when the pivot direction of the arms is directed essentially toward the center of the pallet area when the edges of the shrink wrap are folded back. In other words, the arms should pivot in such a manner that the arm which is the front one in the direction of transport of the stack of goods points forward in its position of rest and is then pivoted toward the pallet, while the arm which is the back one in the direction of transport of the stack of goods points to the rear in its position of rest and is likewise pivoted toward the pallet.

After the projecting edges of the shrink wrap are moved under the pallet then the palletized stack of goods can be replaced on the conveyor and transported to a shrinking station. Setting the stack of goods on a conveyor clamps the folded-back edges of the shrink wrap fast between the stack of goods and the conveyor, thus fixing them for the transport to the shrinking station and the shrinking process which occurs there. They can no longer be pulled up by the action of the shrinking force. Thus, the conveyor has the task, in addition to its transport function, of fixing the folded-under edges of the shrink wrap after the stack of goods has been lowered.

The conveyor should have conveying elements which move along with the stack of goods deposited on the conveyor during transport. This keeps the folded-under edges from being pressed up again by a relative movement between the stack of goods and the conveying elements.

Such conveying elements can be, for example, transport carriages or supports. It is particularly advantageous to construct the conveyor as chain conveyor with at least two outer chain strands on which the pallet can be set. In order to clamp fast the center area of the folded-under edges too, at least one more chain strand should be provided, in addition between the two outer chain strands.

In order to assure that the folded-back sections on the underside of the pallet are as free of folds as possible, the tools can be slide plates which are located at the height of the upper side of the elevating platform when the platform is raised, and the plate and slide plane of which runs essentially parallel to the transport plane.

The slide plates are flat construction elements which are shifted essentiallly parallel to the underside of the pallet, whereby they catch the projecting edges of the shrink wrap and place them flatly against the underside of the pallet. The continually active flow forces of the suction fan are thus supported in an advantageous manner during the formation of fold-free folded-under sections on the underside of the pallet. Such slide plates are of course positioned on all four sides of the pallet.

In more detail, slide plates can be mounted on the front and the back side, viewed in the direction of transport, of the elevating platform outside of and/or between the tracks of the chain conveyor. These slide plates can be adjusted vertically with the elevating platform and can also shift in and counter to the direction of transport. These slide plates do not hinder the operation of the conveyor, as they are raised and lowered together with the elevating platform and are located outside of or between the tracks of the chain conveyor. It is advantageous to position a slide plate between adjacent tracks of the chain conveyor and/or between adjacent carrier strips of the elevating platform. In this manner, a slide plate can always be provided even in multi-track chain conveyors, between adjacent tracks, so that the front and the back sides of the elevating platform, viewed in the direction of transport, are equipped with slide plates which can catch the associated projecting edges of the shrink wrap over most of their length.

In addition, other slide plates are provided on both sides of the chain conveyor and which slide transversely to the direction of transport. These slide plates are located on both sides of the chain conveyor and can be positioned so that they do not change their height. According to a preferred embodiment of the invention, they should extend over the associated outer track of the chain conveyor when they are pushed under the raised pallet. This provides that the edges of the shrink wrap, which are caught and folded back by these slide plates, are pushed so far under the pallet that they are clamped fast between the pallet and the outer tracks of the chain conveyor after the pallet has been lowered and can thus no longer execute unimpeded movements.

This situation is particularly advantageous if the slide plates positioned on both sides of the chain conveyor overlap at least partially with the slide plates positioned outside the tracks and mounted on the elevating platform when all slide plates have been slid under the pallet, because then the folded-back edges overlap each other in the corner areas like an interlocking box fold. In this instance, the slide plane of the slide plates positioned on both sides of the chain conveyor is of course somewhat higher than that of the other slide plates.

Lift cylinders can be provided as the drives of the slide plates, which cylinders are accuated pneumatically or hydraulically.

Embodiments of the invention shown in the drawings are explained in the following.

FIG. 1 is schematic representation of a side view of a device for packaging palletized stacks of goods.

FIG. 2 is a top view of the object of FIG. 1.

Figure 3:
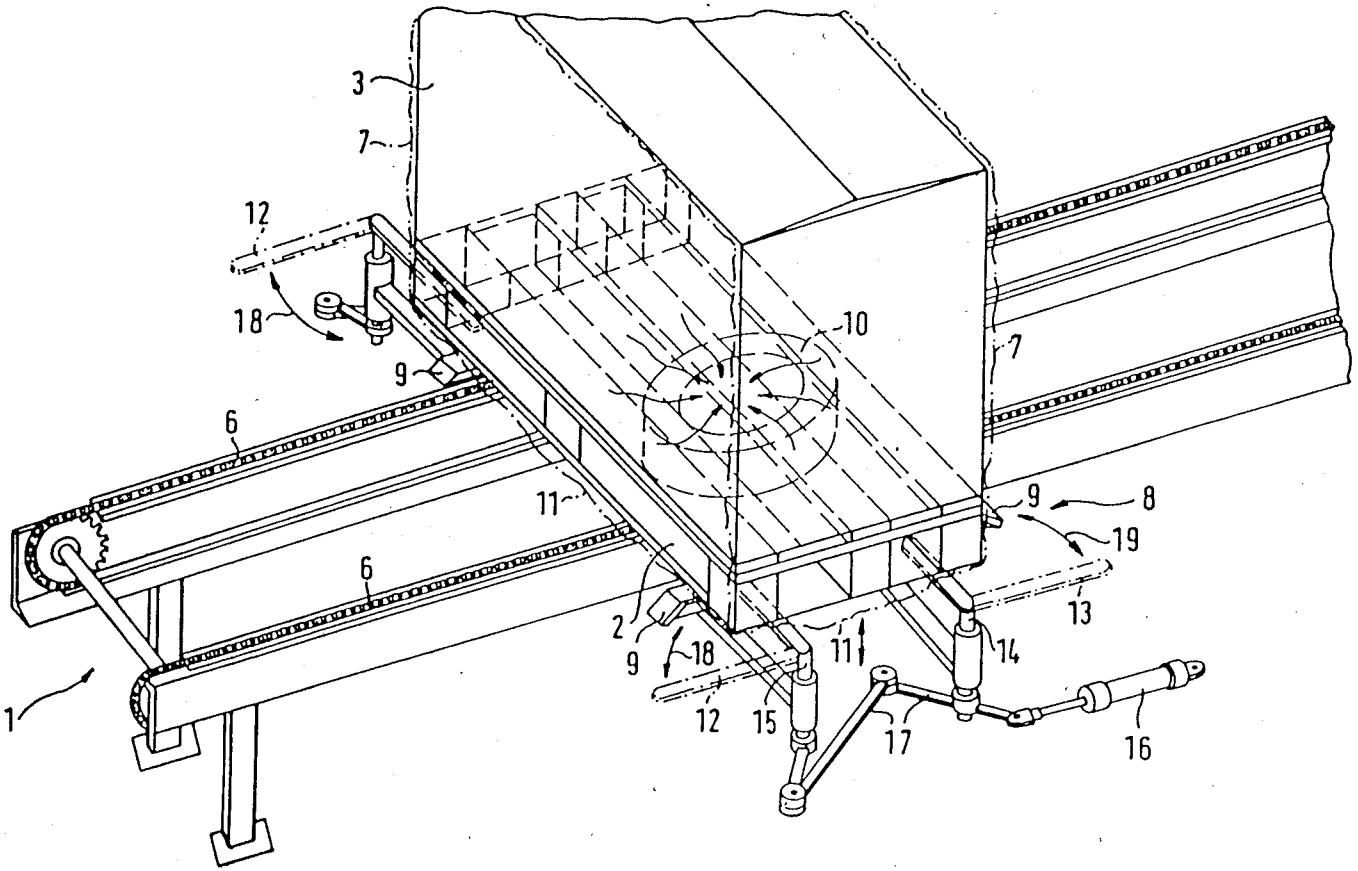
FIG. 3 is perspective view of another embodiment of the object according to FIG. 1.

The device shown consists in its basic construction of intermittently operating conveyor 1 on which pallets 2 with stacks of goods 3 are set and transported first into the zone of a wrap cover station 4, which is not shown in detail, and subsequently into the zone of a shrinking station 5.

Conveyor 1 is a chain conveyor with several tracks 6, with three tracks 6 in the embodiment shown, which run parallel to each other. In the zone of wrap cover station 4, a shrink wrap 7 is pulled over each stack of goods 3 located under wrap cover station 4.

A scissor elevating platform 8 is located under wrap cover station 4, the carrying arms 9 of which platform extend through tracks 6 of conveyor 1 and can thus catch the underside of pallet 2 which is located there.

When pallet 2 passes into the zone of wrap cover station 4, conveyor 1 is stopped and pallet 2 with stack of goods 3 located on it is raised by carrying arms 9 of scissor elevating platform 8, so that shrink wrap 7 is drawn not only over the stack of goods but also over the sides of pallet 2.

In addition, a suction fan 10 is located between carrying arms 9 of scissor elevating platform 8, which fan has the function of sucking the sides of shrink wrap 7 against the associated sides of stack of goods 3 and of placing the free lower edge 11 of shrink wrap 7 under the edge of pallet 2 at the same time.

Pallet 2 is lowered again while suction fan 10 is running, so that free edge 11 of shrink wrap 7 is clamped between the underdside of pallet 2 and the upper side of conveyor 1 and held fast there.

Pallet 2, with stack of goods 3 and shrink wrap 7 is then transported in this state into the zone of shrinking station 5, where shrink wrap 7 is shrunk. Shrinking station 5 has for this purpose a hot gas mast (not shown) which is guided around the stack of goods 3 and from which a jet of hot gas directed at shrink wrap 7 exits. The heat shrinks the material of shrink wrap 7 not only on the free sides of stack of goods 3 but also in the area of free edge 11 located under pallet 2, so that the desired undershrink is produced.

Since air collects again under shrink wrap 7 during the transport from wrap cover station 4 to shrinking station 5, shrink wrap 7 becomes somewhat loose again, because no subpressure is produced under pallet 2. Moreover, the air under shrink wrap 7 is heated by the action of the shrinking device, so that shrink wrap 7 can expand somewhat. However, since it is held by its free edge 11 on the under side of pallet 2, the material of shrink wrap 7 shrinks evenly.

It is not shown that holding devices for pressing the shrink wrap against the free sides of stack of goods 3 can be provided in the zone of shrinking station 5. These holding devices can operate pneumatically.

Since the flow forces decrease as the distance from suction blower 10 increases, tools for folding back projecting edges 11 of shrink wrap 7 under pallet 2 are provided in the zone of the wrap cover station and outside of the pallet transport path. These tools are arms 12, 13, which are positioned in pairs, one arm on each side of conveyor 1 and the wrap cover station 4. The arms 12 and 13 extend basically horizontally and can pivot about vertical axles 14 and 15, respectively. As the drawing shows, the two arms 2, 13, on each side, have a common drive from a lift cylinder 16, which can be accuated pneumatically in the embodiment shown, and from a lever transmission 17 which pivots the two arms 2, 13 in opposite directions, as indicated by arrows 18, 19.

Arm 12 is located at ca. $\frac{1}{4}$ and arm 13 at ca. $\frac{3}{4}$ of the pallet size in the direction of transport. Both arms 12, 13 are at a distance of ca. $\frac{1}{4}$ of the pallet size in the direction of transport from the associated narrow side of the pallet.

Arm 12 is directed against the direction of transport in its rest position, while arm 13 is directed in the direction of transport in its rest position. When left cylinder 16 is accuated, both arms are pivoted toward the pallet and therewith under the pallet, catching projecting edges 11 of shrink wrap 7 and placing them against the underside. Edges 11 can then be held there by the flow forces of suction fan 10.

Pallet 2 is lowered again while suction fan 10 is running, so that the folded-back edge 11 of shrink wrap 7 is clamped in between the underside of pallet 2 and conveyor 1, where it is held fast. In this state, pallet 2 is transported to the shrinking station (not shown), where shrink wrap 7 is shrunk.

The fact that arms 12, 13 can also be shifted vertically is not shown. Then, arms 12,13 are lowered together with pallet 2 after edges 11 have been folded back, until folded-back edges 11 are clamped in and held between pallet 2 and conveyor 1.

Figure 6:
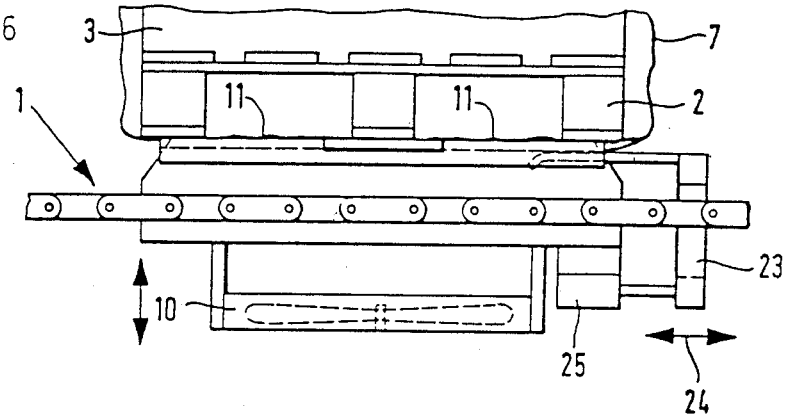
FIG. 6 is a side view in the direction of arrow III of the object of FIG. 4.
Figure 5:
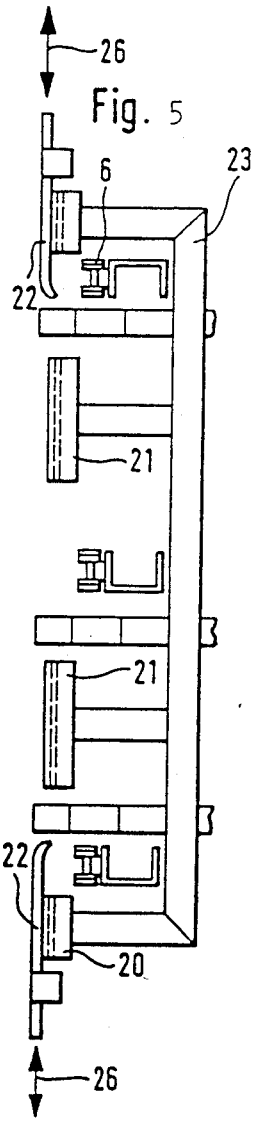
FIG. 5 is a front view in the direction of arrow II of the object of FIG. 4.
Figure 4:
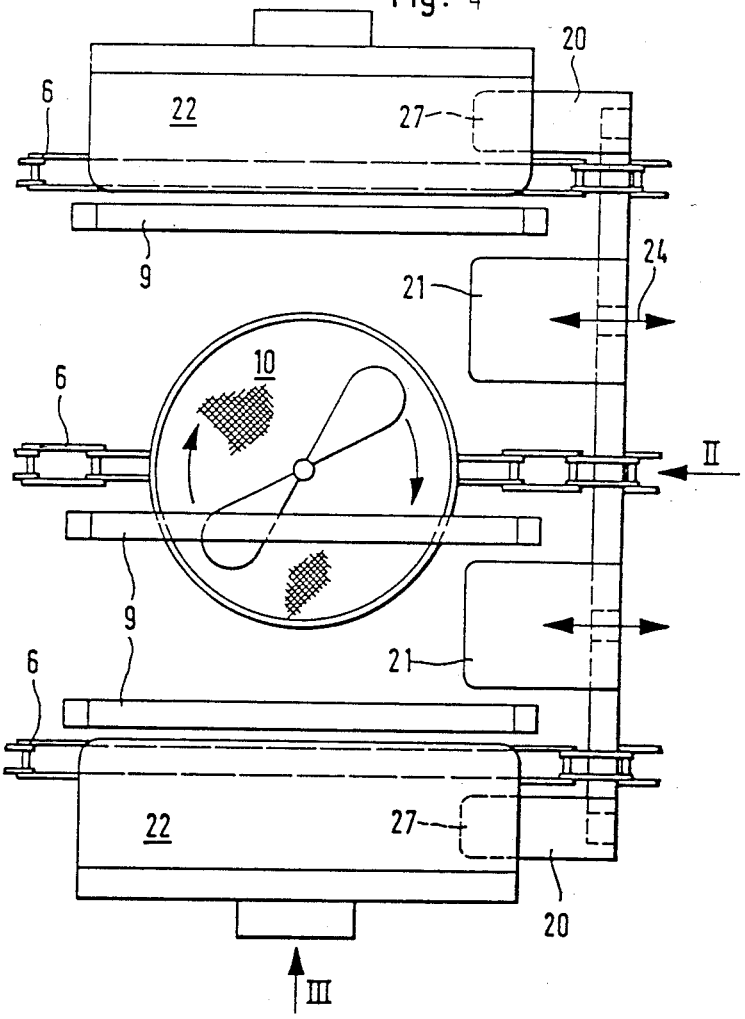
FIG. 4 is a schematic representation of a top view of another device for packaging palletized stacks of goods.

In the device shown in FIGS. 4 to 6, identical reference numerals again designate identical parts. Tools for folding back projecting edges 11 of shrink wrap 7 under pallet 2 are provided in the zone of the wrap cover station in order to support the work of the suction fan. These tools are slide plates 20, 21 and 22 and they are arranged in groups. Slide plates 20, 21 are connected to elevating platform 8 on its front, and backside, respectively, when, viewed in the direction of transport of chain conveyor 1, by means of a carrying frame 23 which can be adjusted together with slide plates 20, 21 in the direction of arrows 24 over lift cylinders 25. Slide plates 20 are located outside outer tracks 6 of chain conveyor 1, while slide plates 21 are positioned between two adjacent tracks 6 of chain conveyor 1 and/or between adjacent carrying arms 8 of elevating platform 9, so that they cannot disturb the operation of chain conveyor 1.

Slide plates 22 are positioned on both sides of chain conveyor 1 outside outer tracks 6 at a set height. They can be shifted by lift cylinders (not shown) transversely to the direction of transport in the direction of arrows 26. These slide plates 22, which shift transversely to the direction of transport, are arranged so that when they are pushed under pallet 2, they cover not only outer tracks 6 of chain conveyor 1 but also outer slide plates 20, which shift in the direction of transport. Therefore, the slide plane of slide plates 22 is somewhat higher than the slide plane of slide plates 20.

The device shown operates as follows: After shrink wrap 7 has been pulled over raised stack of goods 3, suction fan 10 is turned on, if it is not running already, so that projecting edges 11 of shrink wrap 7 are drawn at least in the direction of suction fan 10 and therewith at least partially under the underside of pallet 2 by the action of the flow forces. Then, the drives of slide plates 22 are accuated, so that these slide plates 22 move under pallet 2 from both outer sides of stack goods 3, placing the associated, projecting edges 11 of shrink wrap 7 smoothly under pallet 2. Then, lift cylinders 25 are actuated, so that slide plates 20 and 21 are also pushed under pallet 2 from the front side and/or the back side of stack of goods 3, smoothly placing the associated edges 11 of shrink wrap 7 under pallet 2. A clean fold, like a bottom fold in a box, is produced in the overlapping area 27 between slide plates 20 and 22. Slide plates 22 can then be withdrawn. The associated edges 11 are held under pallet 2 by flow forces and at least in zones also by the folding in overlapping area 27. When pallet 2 is now lowered with slide plates 20, 21, folded-back edges 11, which lie flat under pallet 2, are clamped in between the pallet and tracks 6 of chain conveyor 1. They are no longer capable of moving freely during the following transport to the shrinking station.

I claim:

1. The method of packaging palletized stacks of goods, comprising the steps of:
(a) providing a pallet with peripheral edges and a stack of goods resting on said pallet;
(b) providing a support means disposed beneath said pallet and extending short of said edges;
(c) placing said pallet on a support disposed above said support means;
(d) raising said pallet from said support with said support means;
(e) wrapping said stack of goods with a shrink wrap material so that a portion of said shrink wrap material extends under said edges and short of said support means;
(f) lowering said pallet onto said support for thereby clamping said portion of said shrink wrap material between said support and the underside of said pallet; and,
(g) shrinking said shrink wrap material while maintaining said portion clamped for thereby tightly encasing said stack of goods onto said pallet.

2. The method as defined in claim 1 including the steps of:
(a) evacuating the air from underneath said shrink wrap material for thereby placing said shrink wrap material against said stack of goods under said edges.

3. The method as defined in claim 2, including the steps of:
(a) evacuating the air from the underside of said pallet.

4. The method of packaging a palletized stack of goods, comprising the steps of:
(a) utilizing a wrap station and a shrink station;
(b) utilizing a movable air permeable conveyor between said stations;
(c) utilizing a displacable support means below said conveyor in association with said wrap station wherein said support means is displacable between a lowered and a raised position and where the raised position includes a portion of said support means disposed above said conveyor;
(d) positioning a pallet with peripheral edges and a stack of goods resting on said pallet on said conveyor;
(e) operating said supporting means so that said portion thereof engages the underside of said pallet short of said edges for thereby raising said pallet from said conveyor;
(f) wrapping said stack of goods with a shrink wrap material so that a portion of said shrink wrap material extends under said edges and short of said support means portion;
(g) operating said support means and lowering said pallet thereby so that said portion of said shrink wrap material is clamped between the underside of said pallet and said conveyor;
(h) advancing said pallet from said wrap station to said shrink station; and,
(i) shrinking said shrink wrap material while maintaining said portion of said shrink wrap material clamped for thereby tightly incasing said stack of goods on said pallet.

5. The method as defined in claim 4, including the steps of:
(a) evacuating the air from under said shrink wrap material for thereby placing said shrink wrap material against said stack of goods and under said edges.

6. The method as defined in claim 5, including the steps of:
(a) utilizing a fan underneath said conveyor and adjacent said support means; and,
(b) operating said fan while said pallet is raised for thereby evacuating the air from underneath said shrink wrap material.

7. The method as defined in claim 4, including the steps of:
(a) utilizing a plurality of wrap fold tools having an operating position associated with said pallet when raised and a rest position associated with said pallet when lowered; and,
(b) operating said tools while said pallet is raised so that said tools engage the projecting edges of said shrink wrap material and fold back the projecting edges to a position underneath the underside of said pallet.

8. A device for packaging palletized stacks of goods, comprising:
(a) a wrap cover station including means for placing shrink warp material against a stack of goods and a shrink station including means for shrinking shrink wrap material;
(b) air permeable conveyor means disposed between said stations adapted for conveying a pallet from said wrap station to said shrink station:
(c) elevating platform means disposed below said conveyor means and said platform means includes a displacable portion thereof engagable with the underside of a pallet and extending short of the edges of the pallet and said portion cooperates with said conveyor means for selectively raising a pallet from said conveyor means and for selectively lowering a pallet onto said conveyor means; and,
(d) suction fan means disposed below said conveyor means and operably associated with said wrap cover station whereby operation of said suction fan means while a pallet is raised from said conveyor means and shrink wrap material is placed against a stack of goods resting on the pallet causes the projecting edges of the shrink wrap to be disposed underneath the underside of the pallet and to thereby be clamped between the underside of the pallet and said conveyor when the pallet is lowered onto said conveyor and to remain clamped therebetween during shrinking of the shrink wrap caused by operation of said shrink station means upon advancement of the pallet to said shrink station for thereby tightly encasing the stack of goods on the pallet.

9. The device as defined in claim 8, wherein:
(a) a plurality of support means are associated with said wrap cover station and a plurality of said support means are disposed along a first side of said conveyor means and the remaining suport means are disposed along an opposite second side of said conveyor means;
(b) a plurality of tool means associated with said wrap cover station and each of said tool means is operably associated with one of said support means and cooperates with said elvating platform means for folding back projecting edges of shrink wrap material under the pallet when said elevating platform means raises the pallet from said conveyor means; and, (c) means for operating said tool means for causing said tool means to engage the projecting edges.

10. The device as defined in claim 9, wherein:

(a) each of said tool means includes at least a first arm pivotally mounted to the associated support means and adapted for pivoting about a vertical axis for thereby extending horizontally under the pallet.

11. The device as defined in claim 10, wherein:

(a) said operating means for said first side tool means have a common drive means adapted for causing simultaneous pivoting of said tool means.

12. The device as defined in claim 11, wherein:

(a) said first side arms are interconnected by a lever transmission; and, (b) cylinder and piston means connected to said transmission means whereby operation of said cylinder and piston means causes cooperating operation of said transmission means for thereby causing pivoting of said arms.

13. The device as defined in claim 9, wherein:

(a) each of said tool means includes a slide plate positioned at the height of an upper surface of said elevating platform means when said elevating platform means is raised; and, (b) said slide plates have a slide plane parallel to the underside of the pallet when the pallet is raised from said conveyor means.

14. The device as defined in claim 13, wherein:

(a) a plurality of said slide plates are associated with a first end of said elevating platform means and the remaining slide plates are associated with a back end of said elevating platform means; and, (b) means associated with each of said slide plates cooperating with said elevating platform means for vertically adjusting said slide plate in cooperation with displacement of said elevating platform means.

15. The device as defined in claim 14, wherein:

(a) a plurality of said slide plates disposed along a first side of said conveyor means and the remaining slide plates disposed along a second side of said conveyor means.

16. The device as defined in claim 15, wherein:

(a) said conveyor means includes a multi-track chain conveyor having cooperating outer chain tracks;

(b) said slide plates disposed over the associated chain tracks when said means operate said tool means.

17. A device as defined in claim 14, wherein:

(a) said conveyor means includes a multi-track chain conveyor; and, (b) said slide plates are disposed between adjacent tracks of said chain conveyor.

18. The device as defined in claim 14, wherein:

(a) said elevating platform means includes parallel carrying arms; and, (b) said slide plates disposed between said carrying arms.

19. The device as defined in claim 10, wherein:

(a) two of said arms are disposed along said conveyor means first side and two of said arms are disposed along said conveyor means second side.

20. The device as defined in claim 19, wherein:

(a) said arms of each side are separated apart a distance substantially equal to one half the length of the pallet whereby each of said arms is spaced from its associated end of the pallet by a distance substantially equal to $\frac{1}{4}$ the pallet length for thereby facilitating grasping of the corner areas of the shrink wrap material.

21. The device as defined in claim 19, wherein:

(a) lift means are associated with each of said arms and cooperate with said elevating platform means for reciprocally vertically displacing said arms during raising and lowering of the pallet.

22. The device as defined in claim 8, wherein:

(a) holding device means associated with said wrap cover station cooperating with said elevating platform means for pressing shrink wrap against the sides of said stack of goods.

23. The device as defined in claim 8, wherein:

(a) transport carriage means are associated with said conveyor means and displacable therewith and adapted for receiving said stack of goods and transporting said stack of goods between said stations.

24. The device as defined in claim 8, wherein:

(a) said conveyor means includes a multi-track chain conveyor.

25. The device as defined in claim 24, wherein:

(a) said elevating platform means includes cooperating scissor members adapted for being displaced between a lowered and raised position; and, (b) carrying arms are associated with each of said scissor members and disposed between the tracks of said conveyor for engaging the underside of a pallet and for raising said pallet from said conveyor when said scissor members are displaced from said lowered to said raised position and for lowering a pallet onto said conveyor when said scissor members are displaced from said raised to said lowered position; and, (c) means associated with said scissor members for raising and lowering said scissor members.

26. The device as defined in claim 25, wherein:

(a) said suction fan means disposed between said carrying arms.

27. The device as defined in claim 24, wherein:

(a) said multi-track chain conveyor includes at least two outer chain strands for supporting said stack of goods.

28. The device as defined in claim 27, wherein:

(a) an inner chain strand is disposed between said outer chain strands.

* * * * *